US005370249A

United States Patent [19]

Harvey et al.

[11] Patent Number: 5,370,249

[45] Date of Patent: Dec. 6, 1994

[54] DISPLAY FIXTURE ASSEMBLY

[75] Inventors: Thomas D. Harvey, Rockville; Duncan A. McTaggart, Catonsville, both of Md.

[73] Assignee: Russell-William, Ltd., Odenton, Md.

[21] Appl. No.: 149,611

[22] Filed: Nov. 9, 1993

[51] Int. Cl.[5] ..... A47F 5/00

[52] U.S. Cl. ..... 211/189; 211/87; 211/90

[58] Field of Search ..... 52/36.1, 36.4, 36.5, 52/36.6; 211/189, 87, 103, 90

[56] References Cited

U.S. PATENT DOCUMENTS

| | | | |
|---|---|---|---|
| 3,482,706 | 12/1969 | Stewart | 211/87 |
| 4,086,978 | 5/1978 | Clements | 52/36.6 X |
| 4,570,390 | 2/1986 | Wendt | 211/90 X |
| 4,914,878 | 4/1990 | Tamaki et al. | 52/36.6 X |
| 4,918,879 | 4/1990 | Boduvow et al. | 52/36.6 |
| 5,285,602 | 2/1994 | Felton | 52/36.6 |

*Primary Examiner*—Robert W. Gibson, Jr.
*Attorney, Agent, or Firm*—Norman E. Lehrer

[57] ABSTRACT

A display fixture assembly includes spaced apart horizontally arranged base and top members with a plurality of spaced apart vertical standards welded thereto. Each standard has vertically arranged notches formed on its side edges and a vertical column of elongated slots formed in its center portion. A plurality of sheet metal panels form the skin of the unit. Each panel carries hooks on its side edges which secure the panel to a pair of adjacent standards. With the panels assembled, support brackets can be attached to the slots in the brackets through the narrow space remaining between adjacent panels.

7 Claims, 3 Drawing Sheets

DISPLAY FIXTURE ASSEMBLY

BACKGROUND OF THE INVENTION

The present invention is directed toward a display fixture assembly and more particularly toward such an assembly which is extremely attractive and flexible in arrangement but which is extremely structurally rigid.

Display fixtures are widely used in various areas of business and industry for displaying products or for advertising or promoting the same. Such displays are used, for example, in retail stores for storing and displaying the merchandise being sold.

It is normally desirable, particularly in higher priced stores, to have the display fixtures be as attractive as possible so as to better promote the sale of the products being offered. For this reason, the fixtures are frequently covered or otherwise finished with decorative panels or other coverings. In addition, many store fixtures must be custom designed and constructed in order to accommodate the particular floor space available in the store and also to properly display the goods being offered for sale. All of the foregoing have caused conventional display fixtures to be relatively expensive.

Many display fixtures have brackets or the like secured thereto which may be used to support the fixture, to support shelves carried by the main portion of the fixture or to attach other accessories or the like. In custom installations, these brackets may be permanently secured to a portion of the fixture. However, it is frequently desirable to have the flexibility of being able to move the brackets from one place to another. This would be desirable, for example, if one wished to be able to adjust the height of a shelf or to vary the number of shelves of a store display fixture.

A conventional way of providing adjustable shelves is to attach a vertical, metal standard having a plurality of slots therein to the main portion of the display fixture. Shelf brackets can then be inserted into the desired slots in order to locate a shelf at a desired position. With such conventional systems, the shelf standard with all of the slotted openings therein is normally readily visible and detracts from the appearance of the overall display fixture.

To Applicants' knowledge, no one prior to their invention has designed a display fixture which allows for flexibility in construction and arrangement yet which is extremely structurally strong while being attractive and further being capable of being produced at a relatively low cost. Prior art display fixtures lack one or more of these attributes.

SUMMARY OF THE INVENTION

The present invention overcomes all of the deficiencies of the prior art described above and results in a display fixture which is extremely attractive and lightweight but structurally rigid and flexible in arrangement and which can be produced at a relatively low cost. The display fixture assembly of the present invention includes spaced apart horizontally arranged base and top members with a plurality of spaced apart vertical standards welded thereto. Each standard has vertically arranged notches formed on its side edges and a vertical column of elongated slots formed in its center portion. A plurality of sheet metal panels form the skin of the unit. Each panel carries hooks on its side edges which secure the panel to a pair of adjacent standards. With the panels assembled, support brackets can be attached to the slots in the brackets through the narrow space remaining between adjacent panels.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
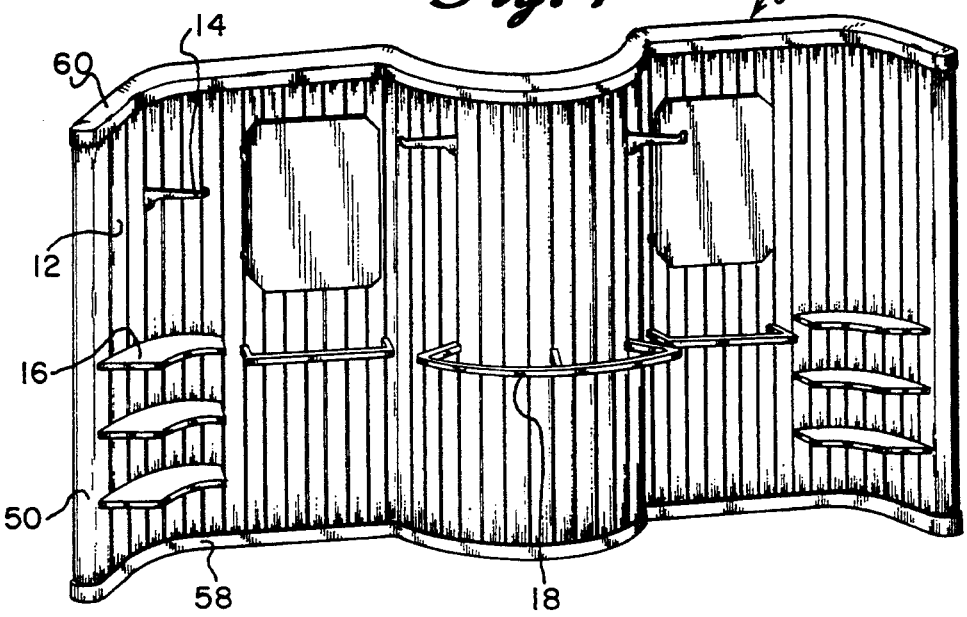
FIG. 1 is an overall view of one possible arrangement of a display fixture assembly constructed in accordance with the principles of the present invention.

Referring now to the drawings in detail wherein like reference numerals have been used throughout the various figures to designate like elements, there is shown in FIG. 1 a perspective view of a display fixture assembly constructed in accordance with the principles of the present invention and designated generally as 10. The assembly 10 is essentially a vertically extending wall formed of a plurality of elongated panel sections 12. The panel sections 12 may be of the same or different width and may have decorative finishes or decorative or functional elements attached thereto. The overall height of the wall and each of the panel sections 12 may be several feet or more than 10 or 12 feet as may be desired for any particular installation or display.

A plurality of brackets such as shown, for example, at 14 are secured to the assembly 10 in a manner which will be described in more detail hereinafter and extend substantially horizontally therefrom. These brackets may be utilized to hang articles directly therefrom or to support shelves 16 or rails 18 or the like. As will become clearer hereinafter, the shape and arrangement of the display fixture assembly 10 shown in FIG. 1 is by way of example only. Numerous different arrangements are possible with the present invention.

Figure 5:
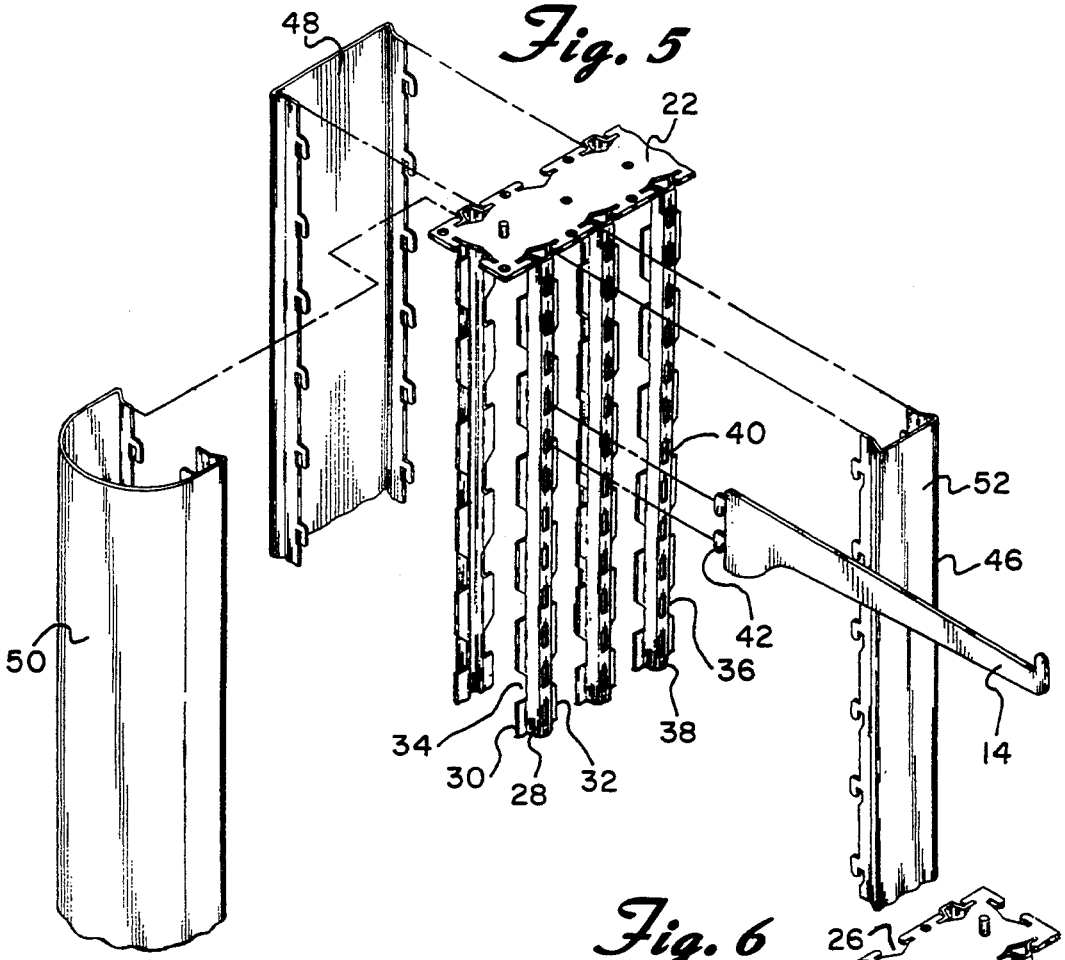
FIG. 5 is an exploded view of the display fixture shown in FIG. 2 illustrating the details of the interrelationship of the component parts thereof.
Figure 6:
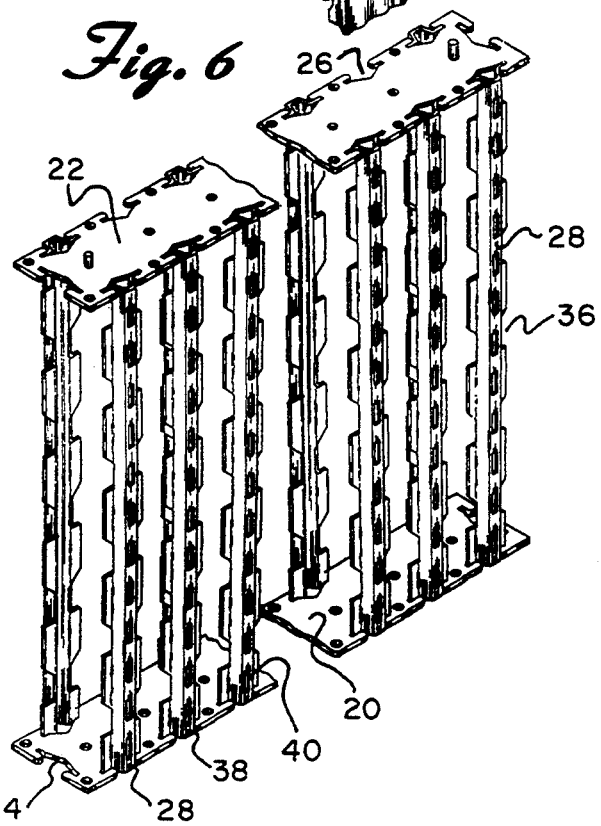
FIG. 6 is a perspective view illustrating the manner in which the core of the display fixture assembly is constructed.
Figure 4:
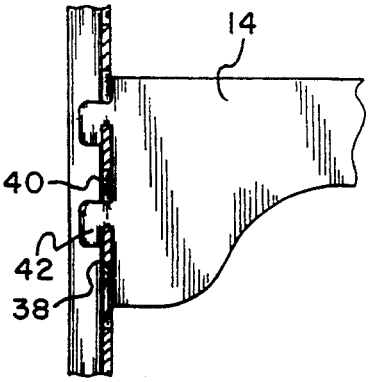
FIG. 4 is a cross-sectional detailed view showing the manner in which a shelf bracket or the like attaches to the display fixture.

The details of the manner in which the wall portion of the display fixture assembly 10 of FIG. 1 is constructed are best shown in FIGS. 2–6. With reference to FIG. 6, it can be seen that the interior structural portion of the wall is comprised essentially of a bottom horizontally extending base member 20 and a horizontally extending top member 22. Members 20 and 22 have substantially the same configuration and are spaced apart but substantially in direct alignment with each other. The space between the base member 20 and the top member 22 is substantially equal to the desired height of the display fixture. In some installations, and particularly when the height of the display fixture exceeds several feet, it may be necessary or desirable to include one or more intermediate members similar to the base and top members 20 and 22.

The members 20 and 22 (and any similar intermediate members) are preferably made of metal although it is possible that other materials might be utilized. Furthermore, they are preferably substantially flat but, again, other shapes may be possible. Formed in the peripheral edges of the base member 20 are a plurality of recesses or cutouts 24. Similar recesses or cutouts 26 are formed in the top member 22. Each of the recesses 24 is in direct alignment with a similar recess 26 thereabove.

Extending between the base member 20 and the top member 22 are a plurality of vertically aligned standards 28. The standards are preferably made from metal and have opposed side edges 30 and 32 with a plurality of notches such as shown at 34 and 36 formed therein. Preferably, there are a plurality of such notches formed along the vertical length of the standard 28. The central portion or area 38 of each of the standards 28 also includes a plurality of vertically spaced elongated slots 40 formed therethrough. The slots 40 are preferably of rectangular area and are substantially the same as those formed in conventional shelf braces which are adapted to receive the locking tabs 42 of shelf bracket 14 (or other types of brackets) in a manner which is well known to those skilled in the art.

In order to increase the structural rigidity and strength of the standards 28 and, therefore, the display fixture assembly 10, each standard 28 has its opposed sides bent backwardly on either side of the central area 38 and then again bent outwardly so as to form the opposed side edges 30 and 32. The cross-sectional configuration of each standard 28 corresponds to the shape of the cutouts 24 and 26 formed in the members 20 and 22 (and similar cutouts in any intermediate members). This allows the ends of the standards 28 to be inserted therein and then, preferably welded thereto.

The number of standards 28 utilized in any particular installation will, of course, vary depending on the desired arrangement and strength which is required. The standards may be as close as 2-inches apart (or less) and may be welded into each of the cutouts 26 as shown at the front of FIGS. 5 and 6 or may be spaced further apart and welded into every other cutout 26 as shown at the back of FIGS. 5 and 6. Furthermore, there may be installations wherein it might be desirable to have some of the standards located close to each other and others spaced further apart.

The primary structural support of the display fixture assembly of the present invention is provided by the bottom and top members 20 and 22 and the interconnecting standards 28. The finished appearance of the assembly is provided by a plurality of panels which are shown, for example, at 46, 48 and 50 in FIG. 5. These panels are essentially the panels referred to as 12 in FIG. 1 and form the skin of the display fixture assembly 10.

Figure 3:
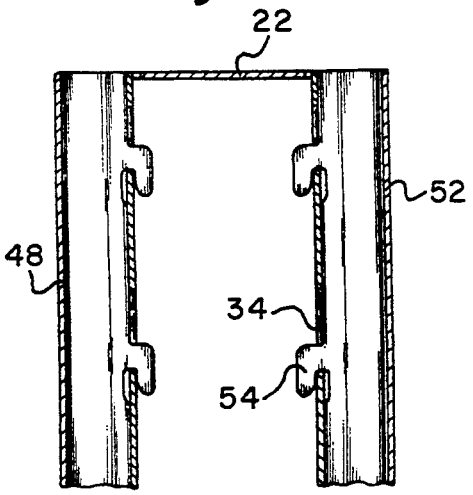
FIG. 3 is a cross-sectional view taken through the line 3—3 of FIG. 2.

Panel 46, as shown, is preferably made of sheet metal and includes a substantially planar surface 52 having its side edges bent rearwardly and terminating in a plurality of hooks 54. Panel member 52 is vertically aligned and has a height which is substantially equal to the height of the standards 28. The hooks 54 correspond in number and location with the notches 34 and 36 formed in the standards 28 and are adapted to engage the standards so as to secure the panel onto the standards as shown in FIG. 3.

FIG. 5 illustrates a panel 46 which is adapted to be removably secured to a pair of adjacent standards which are relatively closely spaced with respect to each other. The panel 48 is constructed in a manner similar to panel 46 but is essentially twice as wide. The panel 48 is adapted to be similarly removably secured to the pair of adjacent standards on the far side of FIG. 5 which are spaced at twice the distance as the standards shown on the forward side of FIGS. 5 and 6. However, this is by way of example only. Smaller panels could have been used on the far side with standards that were closer together or it is also possible to utilize panel 48 on the front of the assembly shown in FIGS. 5 and 6 by having the panel 48 being removably secured to the first and third standards with the middle standard merely being covered by the panel 48.

Although the panels 46 and 48 are shown as being substantially planar, it should be readily apparent that the surface thereof may have substantially any configuration and may be decorative, as desired. Furthermore, different shaped panels may be formed to cover corners or ends or the like. Panel 50, for example, shown in FIGS. 1, 2 and 5 have a rounded configuration in order to cover the end of the display fixture. Irrespective of the shape of the panel, however, each will include tabs such as shown at 54 which will allow the same to be secured to the notches on the standards 28.

While the panels provide a decorative finish or skin for the display fixture, it should be noted that they are not merely decorative but also provide structural support therefor. Because of the interlocking of the panels with the standards and, therefore, the base and top members, they add support and strength to the entire system. This makes it possible to manufacture the base and top members, the standards and the panels from lighter weight and thinner gauge materials. The result, of course, is a lighter weight and less expensive display fixture which still provides adequate support and strength for its intended purpose.

Figure 2:
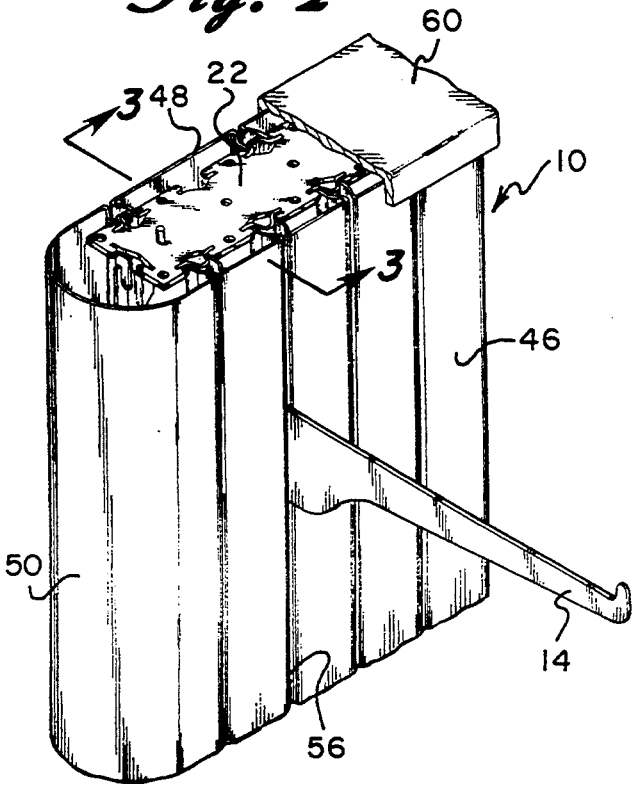
FIG. 2 is a perspective view of a section of a wall of the display fixture assembly with a portion broken away for clarity.

As shown best in FIG. 2 (and in FIGS. 7–7*e*), when adjacent panels are secured to the standards, a small elongated vertical space 56 remains between the panels. In a preferred embodiment of the invention, this space is approximately 0.14 inches wide. Space 56 allows access to the slots 40. This space 56 is only slightly wider than the width of the slots so that the slots 40 are accessible but not easily visible. This allows the brackets 14 or other brackets to be inserted into or removed from desired slots 40.

In order to provide for additional support, the base member 20 may be further secured to a metal or wooden base or platform (not shown) and trim or the like such as shown at 58 may be applied to the base. Similarly, a cap such as shown at 60 in FIGS. 1 and 2 may be applied over the top of the assembly in order to provide a finished appearance to the top thereof.

Figure 7:
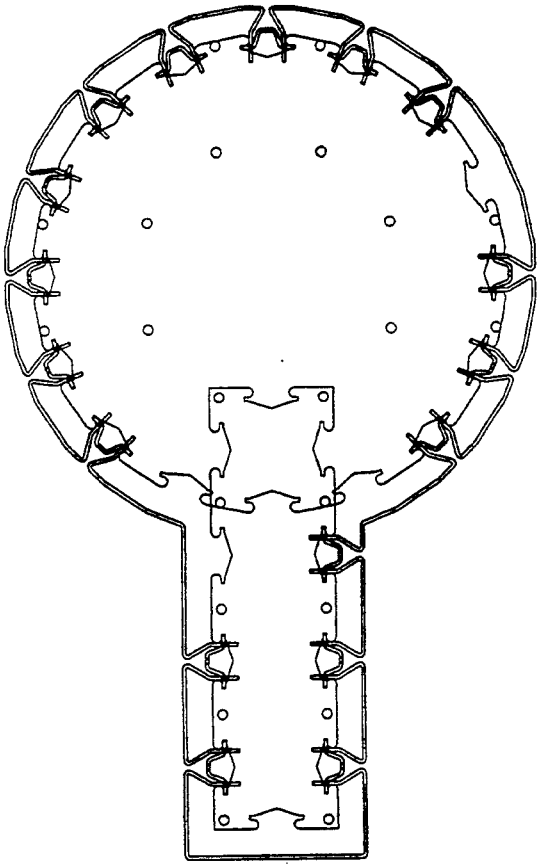
FIGS. 7–7*e* are top plan perspective schematic representations illustrating various different arrangements that are possible with the display fixture assembly of the present invention.
Figure 7A:
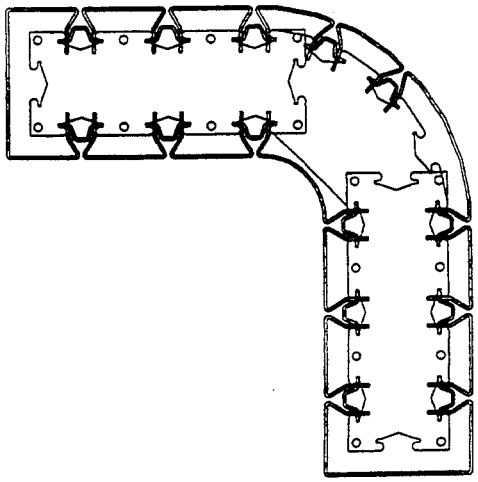
Figure 7B:
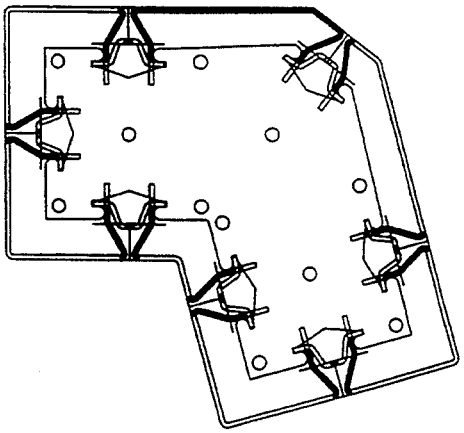
Figure 7C:
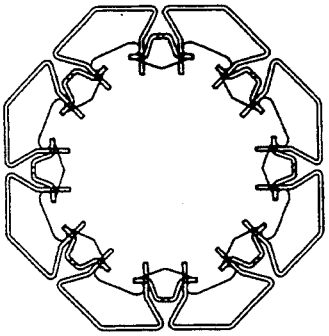
Figure 7D:
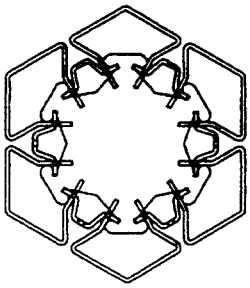
Figure 7E:
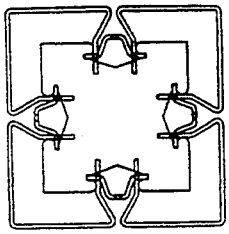

Although the base member 20 and the top member 26 described above are essentially rectangularly shaped and elongated, it should be readily apparent to those skilled in the art that various other shapes are possible. These various shapes are shown, for example, in FIGS. 7–7*e*. FIGS. 7, 7*c* and 7*d* show circularly shaped base and top members with the panels of FIG. 7 being arcuate while the panels of FIGS. 7*c* and 7*d* are rectilinearly shaped. FIGS. 7 and 7*a* also show combinations of curved and straight members while FIG. 7*e* illustrates a square which could be used to form a vertical post or column or the like.

Furthermore, while the details of a shelf bracket 14 have been illustrated, it should be readily apparent that various other types of brackets could be utilized. For example, a pair of columns such as could be made from a square display fixture as shown in FIG. 7*e* could be secured together utilizing a bracket extending between them which has locking tabs at each end similar to tabs 42 of the shelf bracket 14. In addition, while the display fixture assembly 10 or similar assemblies may be free standing, it is also possible to secure the same to an existing wall or other structural support utilizing brackets which can be secured to the standards in much the same manner as the shelf bracket 14.

The present invention may be embodied in other specific forms without departing from the spirit or essential attributes thereof and accordingly reference should be made to the appended claims rather than to the foregoing specification as indicating the scope of the invention.

We claim:

1. A display fixture assembly comprising:

a bottom horizontally extending base member;

a horizontally extending top member, said top member having a configuration substantially the same as said base member but being spaced therefrom;

a plurality of spaced apart vertically aligned standards, said standards extending between said base and top members and being secured thereto;

each of said standards having opposed side edges and including a plurality of notches formed in said edges, said notches being spaced along the vertical length of the standard;

each of said standards further having a plurality of vertically spaced elongated slots formed therein, said slots being located in the central area of the standard between the side edges thereof;

a plurality of vertically extending panel members, each of said panel members having side edges with a plurality of vertically spaced hooks formed thereon, said hooks cooperating with said notches such that a panel can be removably secured to a pair of adjacent standards with the slots of said pair of standards remaining unobstructive, and a plurality of support brackets, each of said support brackets including a tab lock extending therefrom adapted to fit within one of said slots to removably secure the bracket to one of said standards.

2. The invention as claimed in claim 1 wherein each of said panels extends forwardly of said standards.

3. The invention as claimed in claim 1 wherein a vertically extending elongated space is formed between two adjacent panels when they are assembled onto said standards.

4. The invention as claimed in claim 3 wherein said space is in substantial alignment with the slots in the standard to which both adjacent panels are attached, said space being only slightly wider than the width of said slots.

5. The invention as claimed in claim 1 wherein said base and top members and said standards are made of metal.

6. The invention as claimed in claim 5 wherein said standards are welded to said base and top members.

7. The invention as claimed in claim 1 wherein said panels are formed from sheet metal.

* * * * *